United States Patent [19]

Bennett

[11] 4,023,848

[45] May 17, 1977

[54] LOG GRAPPLE

[75] Inventor: Wilbur G. Bennett, Terre Haute, Ind.

[73] Assignee: J. I. Case Company, Racine, Wis.

[22] Filed: Jan. 5, 1976

[21] Appl. No.: 641,857

[52] U.S. Cl. ..... 294/88; 294/106; 214/147 G

[51] Int. Cl.[2] ..... B66C 3/16

[58] Field of Search ..... 294/88, 106, 118, 113 R, 294/66 R, 70, 86 R, 81 R, 119, 103 CG; 37/183 R, 184, 185, 186, 187, 188, 183 A; 214/147 G, 653, 501, 92, 75 R; 212/7

[56] References Cited

UNITED STATES PATENTS

| | | | |
|---|---|---|---|
| 3,421,791 | 1/1969 | Lindquist | 294/88 |
| 3,627,372 | 12/1971 | Carpenter et al. | 294/88 |
| 3,933,389 | 1/1976 | Korbel | 214/147 G |

*Primary Examiner*—James B. Marbert
*Attorney, Agent, or Firm*—Cullen, Settle, Sloman & Cantor

[57] ABSTRACT

An improved log grapple having a pair of grapple arms each supported on a head by a drive link or lever and a driven link. The levers are pivotally supported between their ends on a common central pivot on said head and the driven links are each pivotally supported on said head outboard of the common lever pivot. Each link and lever then cross to define an X-linkage with the lower ends pivotally connected to the upper end of one grapple arm, with the driven link connections inboard of the lever connections. A drive means then rotates the upper free ends of the levers to relatively close the grapple arms, then lifting the arm ends to securely embrace logs received therebetween.

9 Claims, 6 Drawing Figures

LOG GRAPPLE

FIELD OF THE INVENTION

A log grapple or skidder particularly for loading and skidding logs having opposed grappling arms or jaws which are power driven.

DESCRIPTION OF THE PRIOR ART

The prior art discloses a number of grapples for logging, including loading devices and log skidders. The simplest form of grapple includes a pair of opposed jaws or tongs which are pivotally supported in spaced relation on a head. The jaws are opened or closed by a pair of hydraulic cylinders pivotally connected at one end to the head, outboard of the jaw connections and the opposite ends are pivotally connected to the outer sides of the jaws. The confronting faces of the jaws are generally concave to receive a log or logs for lifting or skidding. An example of this design is shown in U.S. Pat. No. 3,731,827.

More recently, grappling devices have been developed which more securely retain the logs, particularly during skidding operations. For example, U.S. Pat. No. 3,697,115, discloses an improvement of the tong or jaw configuration, wherein the confronting faces of the jaws include a lower concave portion, which provides a pinching action and an upper convex portion which develops a downward wedging action to more securely retain the logs. The principal disadvantage of this design is that the jaws do not open sufficiently to receive a number of large logs, generally requiring stacking of the logs and the jaw configuration relies upon the wedging action to support the logs. The prior art also includes log grapples, wherein the jaws or arms are supported on a complex linkage which does permit the jaws to be opened wider, however the complex linkage is relatively expensive to produce and generally requires greater maintenance. Further, these designs generally do not firmly grip the logs, particularly where smaller logs are being handled, which is a disadvantage in skidder applications.

The log grapple of this invention eliminates the problems defined above by suppporting the grapple jaws on a relatively simple cross linkage which is pivotally supported on a conventional head. The grapple arms or jaws may be spread wide to receive relatively large logs or logs which are spaced on the ground and the jaws are then closed in a compound arc, wherein the jaw ends are raised to securely embrace the logs received therebetween.

SUMMARY OF THE INVENTION

The log grapple of this invention is particularly adapted for both loading and skidding applications. In loading applications, logs are lifted and loaded on a suitable conveyance, such as a truck or railroad car. In skidding applications, the logs must be firmly retained by the grapple and are then carried or skidded to another location. In the log grapple of this invention, the grapple arms or jaws are supported on a relatively simple cross linkage, which permits the jaws to be opened wide and then closed to firmly grasp and support the logs during loading or skidding applications.

The log grapple of this invention includes a head for connection to a suitable lift mechanism and a pair of opposed grapple arms or jaws which have generally concave confronting faces. Each of the grapple arms are supported on the head by a separate cross linkage, including a drive link or lever and a driven link. The drive links are pivotally supported between their ends on a central pivot on the head, preferably a common pivot. The driven links are pivotally supported adjacent their upper ends on the head on opposed sides of the lever connections or outboard of the common pivot. The lower ends of the levers are then pivotally connected to the upper end of one of the grapple arms and the lower end of the levers are pivotally connected to the grapple arms, outboard of the lever connections. Each lever and drive link thus cross to define an X-linkage and a drive means is provided to rotate the drive links or levers, operating the jaws.

The cross linkage and drive means is thus adapted to open the jaws sufficiently to receive relatively large logs or logs which are spaced on the ground. When the jaws are closed, the tips or lower jaw ends cross and then raise to securely embrace and support the logs confined therebetween.

The drive means in the disclosed embodiment of the log grapple includes a pair of hydraulic cylinders. Each hydraulic cylinder is interconnected between the free upper end of the lever or drive link and the head outboard of the lever connections or common pivot. Extension of the hydraulic cylinders thus opens the jaws and retraction closes the jaws as described. The cross linkage causes the jaws to swing in a compound arc. First, the jaws close to confine the logs. The jaws then cross and are simultaneously raised to securely embrace and support the logs.

As described, the confronting faces of the grapple arms or jaws are generally concave, however in the disclosed embodiment, the driven links include opposed, downwardly facing shoulders which serve to wedge the logs downwardly against the now generally horizontal concave faces of the grappling arms. The log grapple of this invention is thus adapted to securely retain a single, relatively small log or a number of large logs for either loading or skidding applications.

Other advantages and meritorious features of the present invention will be more fully understood from the following description of the preferred embodiments, the appended claims and the drawings, a description of which follows.

DESCRIPTION OF THE PREFERRED EMBODIMENTS AND DRAWINGS

Figure 1:
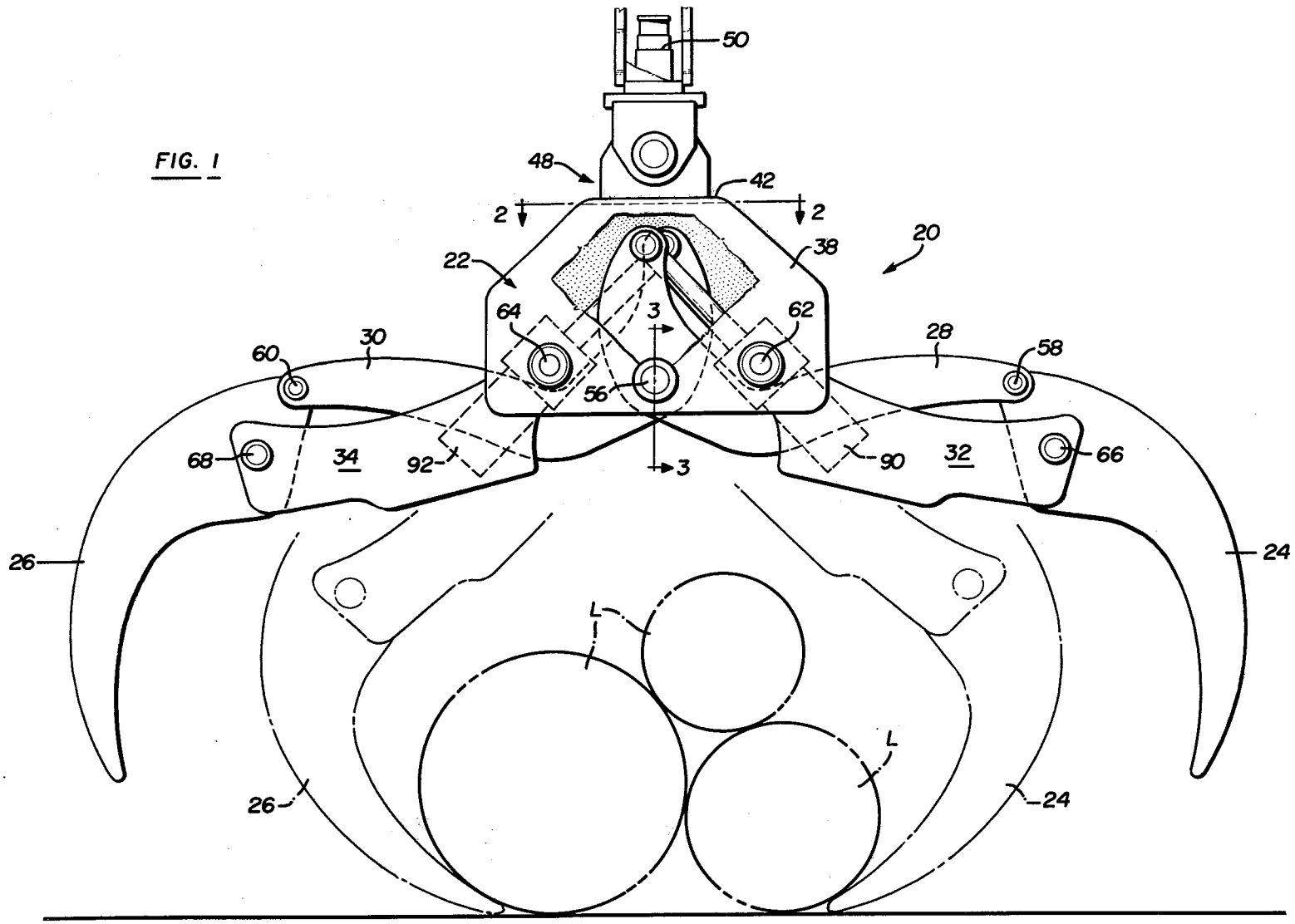
FIG. 1 is a front elevation of one embodiment of the log grapple of this invention, partially cut away for clarity.

The disclosed embodiments of the grappling device 20 of this invention includes a support or head 22 and a pair of opposed arcuate grapple arms or jaws 24 and 26. The grapple arms are supported on a cross or X-linkage, including a pair of drive links or levers 28 and 30 and a pair of driven links 32 and 34. Each grapple arm is supported for actuation by a drive link or lever and a driven link. For example, grapple arm 24 is supported by lever 28 and link 32.

Figure 2:
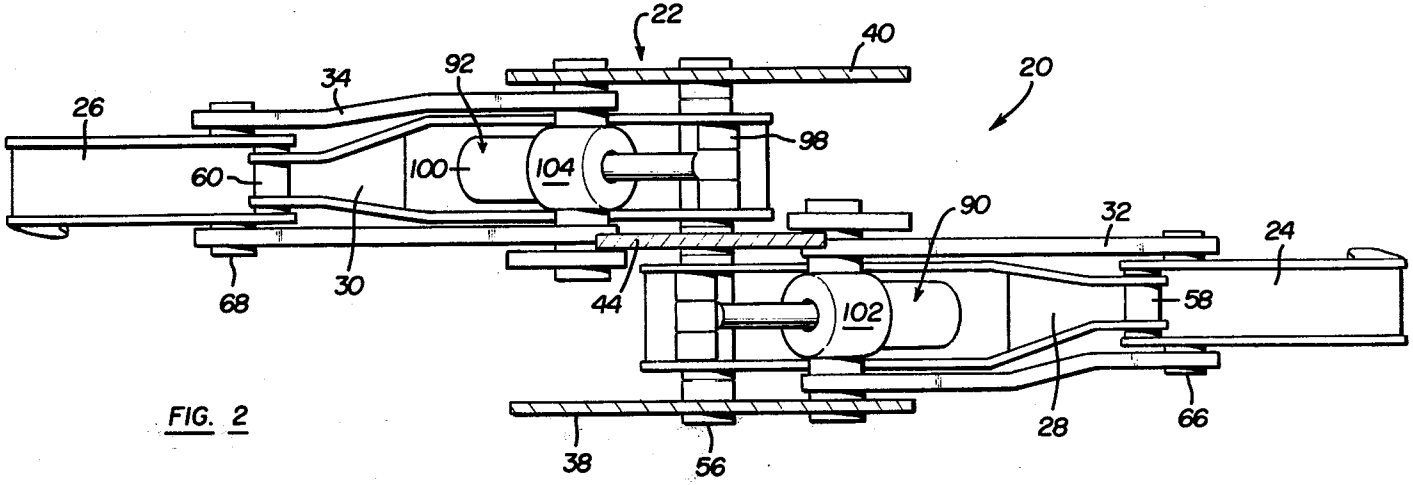
FIG. 2 is a top cross sectional view of the log grapple shown in FIG. 1, in the direction of view arrows 2—2.
Figures 4, 5:
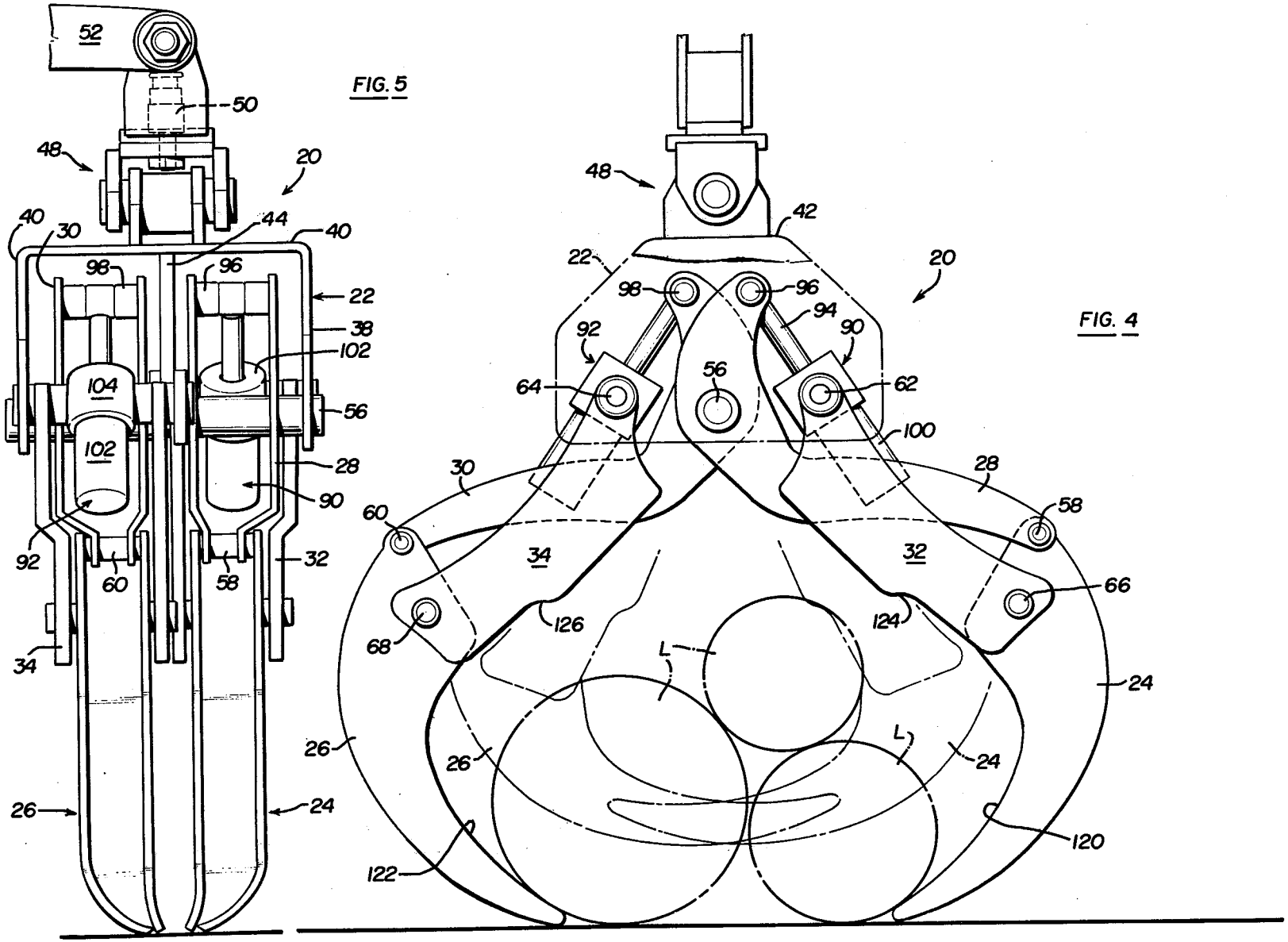
FIG. 4 is a front elevation of the log grapple shown in FIG. 1, illustrating the movements of the grappling arms or jaws.
FIG. 5 is a side view of the log grapple shown in FIGS. 1 and 4.

The disclosed embodiment of the head or support 22 includes opposed end plates 38 and 40, see FIG. 2, a top plate 42, see FIGS. 1 and 4 and a center support plate 44 as shown in FIG. 2. It will be understood that various modifications may be made to the box-like construction of the disclosed head, including partially enclosing the sides. The plates may be formed of any suitable steel, which may be welded or otherwise secured. In a typical application, the log grapple is supported on a boom 52, as shown in FIG. 5, which is interconnected to the top plate 42 of the head through a pivot or universal joint 48. In the disclosed embodiment, a hydraulic motor 50 is provided which controls the position of the grapple. The details of the boom, pivot 48 and hydraulic motor control 50 may be found in the prior art and no further description is made herein. It is sufficient to state that the grapple may be raised, lowered and turned to position the grappling arms for operation as described hereinbelow.

As best shown in FIG. 4, the drive links or levers 28 and 30 are generally J- or U-shaped, opening outwardly. The levers are pivotally supported on the head on a common pivot 56 in the disclosed embodiment, although it will be understood that the pivotal connections may be offset. The lower end of the levers are pivotally connected to the grapple arms. Lever 28 is pivotally connected on pivot pin 58 to grapple arm 24 and lever 30 is pivotally connected by pivot pin 60 to grapple arm 26. The driven links are pivotally supported on the head, outboard of the common pivot 56 as shown in FIG. 4. Link 32 is supported on pin 62 and link 34 is supported on pin 64. The lower end of link 32 is pivotally connected by pivot pin 56 to grapple arm 24 and link 34 is pivotally connected to grapple arm 26 by pivot pin 68.

Figure 3:
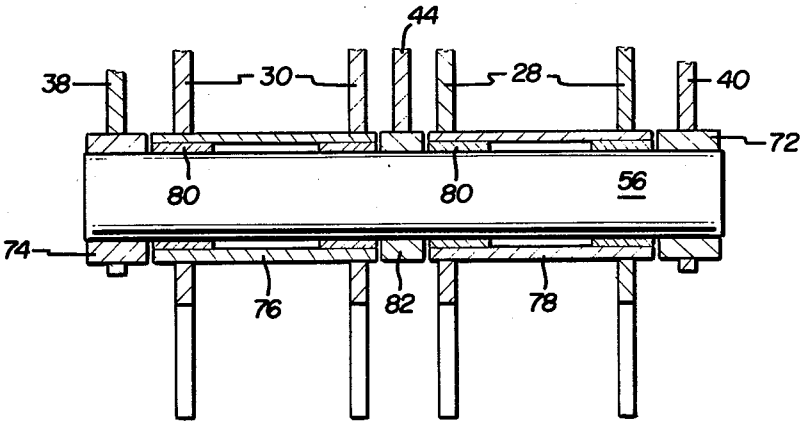
FIG. 3 is a partial side cross sectional view of the log grapple embodiment shown in FIG. 1, in the direction of view arrows 3—3.

It will be seen, particularly from FIGS. 2 and 5, that the cross linkage defined by the drive links or levers 28 and 30 and the driven links 32 and 34, have been constructed to provide ultimate strength with minimum weight. The levers 28 and 30 include sidewalls and a bridging web and are nestable within the driven links 32 and 34, respectively. The levers and links may be formed of conventional steel plates, which may be welded together as required. The pivotal connections may be of conventional design. FIG. 3 illustrates one suitable embodiment for the center or common pivot 56. The end plates 38 and 40 are connected to the pivot pin 56 by rings 72 and 74, respectively, by any suitable means including welding. The plates which define levers 28 and 30 are welded or otherwise secured to bearing elements 76 and 78, respectively. The bearing elements include bearing pads 80 to reduce the friction against pivot pin 56. The central support 44 is secured to pivot pin 56 by ring 82.

The drive means for the disclosed embodiment of the grappling device includes a pair of hydraulic cylinders or motors 90 and 92. The rod end 94 of the hydraulic cylinders are pivotally connected to the free upper end of levers 28 and 30 by pivot pins 96 and 98, respectively. In the disclosed embodiment, the cylinder ends 100 are connected to pivot pins 62 and 64 by yokes 102 and 104, respectivey. In effect, the cylinder end of the hydraulic cylinders are therefore connected to the head 22. Retraction of cylinder 90 will thus cause lever 28 to rotate in a clockwise direction and retraction of cylinder 92 will cause lever 30 to rotate in a counterclockwise direction, as more fully described hereinbelow. The control for the hydraulic motors 90 and 92 are not shown, however, it will be understood that the piston rods may be simultaneously extended or contracted by operation of the hydraulic cylinders to actuate the grappling device as described.

Having now described the elements of the grappling device of this invention, the following is a brief description of its operation. As described above, the grappling device 20 may be raised, lowered and rotated, by operation of boom 52 and hydraulic motor 50, to locate the grappling device for loading or skidding logs"L", shown in phantom in FIGS. 1 and 4. The grappling arms 24 and 26 may be extended to their full open positions, as shown in FIG. 1, by extending hydraulic cylinders 90 and 92. Retraction of cylinders 90 and 92 causes levers 28 and 30 to rotate in opposite directions about common pivot 56, thereby causing links 32 and 34 to rotate about pivots 62 and 64, respectively. This movement of the cross linkage causes the grappling arms 24 and 26 to begin to close around the logs L as shown in phantom in FIG. 1. Continued retraction of the hydraulic cylinders 90 and 92 causes the grappling arms 24 and 26 to simultaneously cross and raise, as shown in phantom in FIG. 4 to raise and embrace the logs between the concave confronting surfaces 120 and 122 of the grappling arms 24 and 26, respectively. Continued retraction of the hydraulic cylinders biases the logs against the downwardly facing shoulders 124 and 126 of the links 32 and 34, respectively, wedging the logs securely in position for skidding or loading applications.

Figure 6:
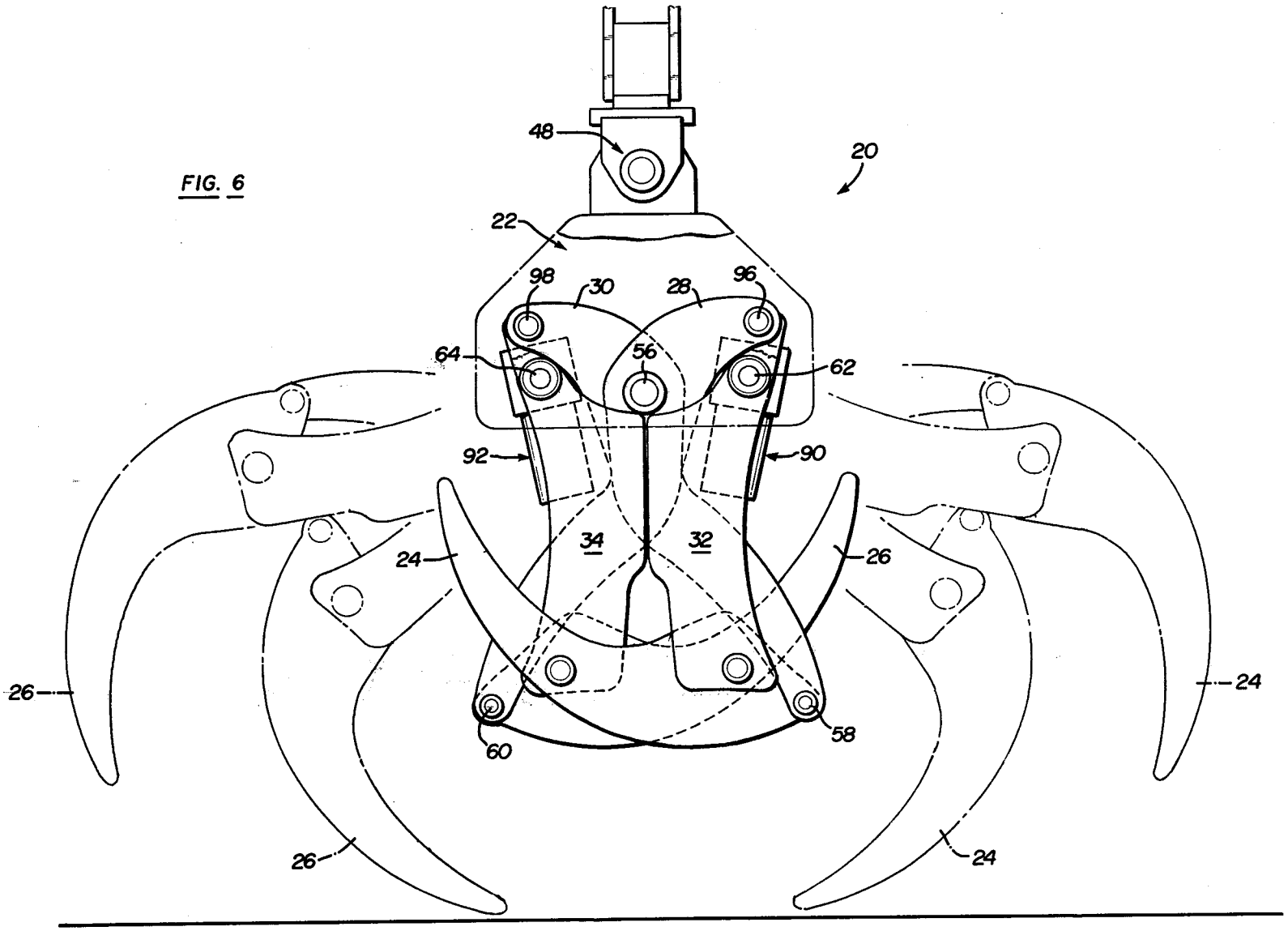
FIG. 6 is a front elevation of the log grapple, similar to FIG. 4, with the grappling arms closed.

Finally, full retraction of the hydraulic cylinders raises the tips of the grappling arms to the position shown in FIG. 6. It will be understood that although the load generally does not require complete closing of the grappling arms or jaws, the grappling device of this invention is capable of grappling relatively small logs and the grappling device may be closed for storage or transport.

The cross or X-linkage utilized in the grappling device of this invention thus provides several advantages over the prior art. The grappling arms are moved in a compound arc, as shown in FIG. 6, permitting the grappling arms to open wide to receive relatively large logs and logs which are spaced upon the ground. The grappling arms then close to receive the logs, then cross to securely embrace and cradle the logs for skidding and loading applications. This is accomplished with a relatively simple linkage, including drive links or levers 28 and 30 and driven links 32 and 34. The drive links 28 and 30 may be characterized as first class levers, pivotally connected between their ends and driven at one end. The driven links 32 and 34 follow the movement of levers 28 and 30 to provide the compound arcuate movement of the grapple arms or jaws.

I claim:

1. A grapple, particularly for logs, comprising a head for connection to a lift mechanism and a pair of opposed arcuate jaws, each of said jaws supported on said head by separate drive and driven links, said drive links each pivotally supported between its ends on a central pivot on said head, each of said driven links pivotally supported adjacent its upper end on said head on opposed sides of said central drive link pivots, the distal lower ends of each of said driven links being pivotally connected to the upper end of one of said jaws and the lower end of each of said drive links being pivotally connected to one of said upper jaw ends outboard of said driven link connections, and a drive means having two hydraulic cylinders, each hydraulic cylinder having a piston rod connected to the free upper ends of said drive links and a cylinder pivotally connected to one of the upper pivotal connections of said drive links, said drive means adapted to rotate said drive links about said central pivots to relatively close said jaws, said jaws then crossing and raising to securely embrace logs confined therebetween.

2. The grapple defined in claim 1, characterized in that the confronting faces of said jaws are concave and the confronting faces of said driven link include opposed downwardly facing shoulders.

3. The grapple defined in claim 1, characterized in that said drive links are pivotally supported on a common pivot on said head, said drive links being generally U-shaped opening outwardly, the lower portion of said drive links each crossing a driven link to define an X-linkage supporting and controlling the movement of said jaws.

4. A grapple, particularly for logs, comprising: a support head, a pair of levers pivotally connected between their ends to the mid portion of said head, a pair of links pivotally connected adjacent one end to said head outboard of said lever connections, a pair of grapple arms having generally concave confronting faces, the lower end of each of said levers pivotally connected to the upper end of one of said arms and the lower end of each of said links pivotally connected to said one of said upper arm ends inboard of said lever connections, whereby each link crosses a lever defining an X-linkage pivotally supporting a grapple arm, and a pair of retractable and extensible drive means each connected between one free upper end of said levers and said head outboard of said lever pivotal connections, said drive means adapted to rotate said levers about their pivotal connections to said head to relatively close said arms, said arms then crossing and the lower distal ends of said arms then raising to securely embrace logs received therebetween.

5. The grapple defined in claim 4, characterized in that said levers are generally U-shaped, opening outwardly and pivotally connected to said head on a common central pivot.

6. The grapple defined in claim 4, characterized in that each of said levers are nested within a link.

7. The grapple defined in claim 6, characterized in that said drive means includes a pair of hydraulic cylinders, each hydraulic cylinder having a cylinder end pivotally connected to one of said upper pivotal connections of said links and said hydraulic cylinders having a rod end pivotally connected to the free end of one of said levers.

8. The grapple defined in claim 7, characterized in that said cylinder end of each of said hydraulic cylinders is nested within one of said links.

9. The grapple defined in claim 4, characterized in that the confronting faces of said arms are generally concave and the confronting faces of said links each include a downwardly facing shoulder portion.

* * * * *